United States Patent [19]

Kageyama et al.

[11] 4,386,865

[45] Jun. 7, 1983

[54] AUTOMATIC SHARP PENCIL

[75] Inventors: Hidehei Kageyama; Takahiko Suzuki, both of Kawagoe, Japan

[73] Assignee: Kotobuki & Co., Ltd., Kyoto, Japan

[21] Appl. No.: 215,311

[22] Filed: Dec. 11, 1980

[30] Foreign Application Priority Data

| | | | |
|---|---|---|---|
| Dec. 28, 1979 | [JP] | Japan | 54-182260[U] |
| Dec. 28, 1979 | [JP] | Japan | 54-182262[U] |
| Dec. 28, 1979 | [JP] | Japan | 54-182263[U] |
| Mar. 4, 1980 | [JP] | Japan | 55-28522[U] |
| Mar. 29, 1980 | [JP] | Japan | 55-41756[U] |
| May 9, 1980 | [JP] | Japan | 55-63436[U] |
| May 23, 1980 | [JP] | Japan | 55-71077[U] |
| May 23, 1980 | [JP] | Japan | 55-71079[U] |

[51] Int. Cl.[3] ..... B43K 21/22

[52] U.S. Cl. ..... 401/67; 401/54; 401/80

[58] Field of Search ..... 401/65, 67, 54, 80

[56] References Cited

U.S. PATENT DOCUMENTS

| | | | |
|---|---|---|---|
| 1,969,085 | 8/1934 | Leistenschneider et al. | 401/67 |
| 2,049,965 | 8/1936 | Leistenschneider | 401/65 |
| 2,319,824 | 5/1943 | Moore | 401/65 |
| 2,525,229 | 10/1950 | Lynn | 401/65 |
| 2,700,959 | 2/1955 | Ginsele | 401/67 |
| 3,627,434 | 12/1971 | Horie | 401/65 |
| 3,854,825 | 12/1974 | Girella | 401/65 |
| 4,165,981 | 8/1979 | Kageyama et al. | 401/67 |
| 4,171,170 | 10/1979 | Kageyama et al. | 401/54 |
| 4,180,339 | 12/1979 | Katz | 401/67 |
| 4,240,759 | 12/1980 | Matsumoto et al. | 401/67 |
| 4,264,227 | 4/1981 | Iwasaki | 401/67 |

FOREIGN PATENT DOCUMENTS

| | | | |
|---|---|---|---|
| 811677 | 8/1951 | Fed. Rep. of Germany | 401/65 |
| 922498 | 6/1947 | France | 401/65 |
| 2013580 | 8/1979 | United Kingdom | 401/67 |

*Primary Examiner*—William Pieprz

*Attorney, Agent, or Firm*—Bernard, Rothwell & Brown

[57] ABSTRACT

A knock type sharp pencil provided in its outer cylinder with a core holding mechanism composed of an inner cylinder coaxially arranged in the outer cylinder, a lead chuck inserted in the inner cylinder and including a chuck portion projecting out of the front end of the inner cylinder, a chuck ring inserted between a flange portion of the inner cylinder and the chuck portion of the lead chuck, a core case provided at its rear end with a knock portion and connected to the rear end of the lead chuck, and a spring means arranged in the inner cylinder and inserted between the flange portion of the inner cylinder and the front end portion of the core case, the spring means urging the core case backwardly.

8 Claims, 19 Drawing Figures

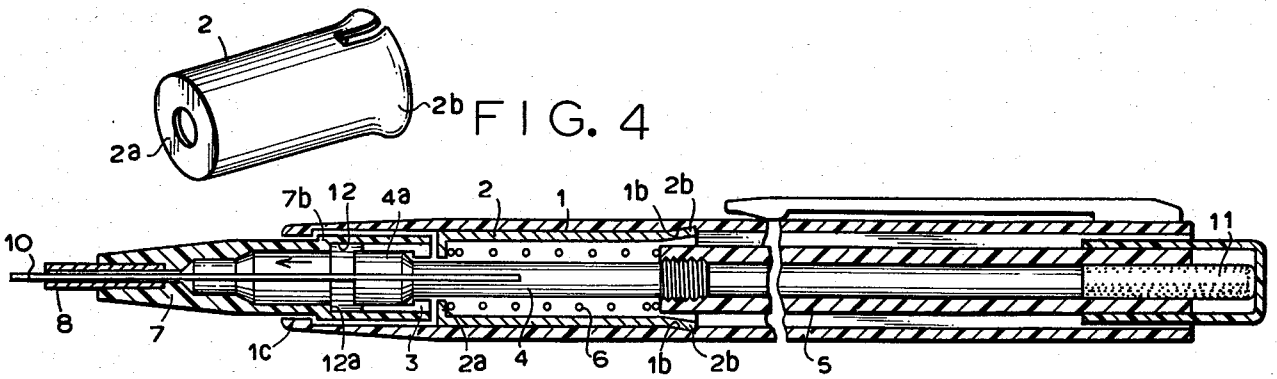
FIG. 4
FIG. 5
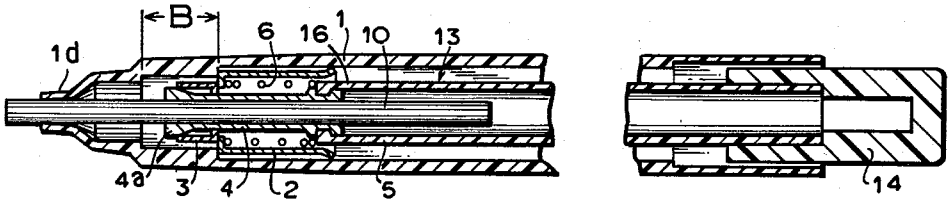
FIG. 6
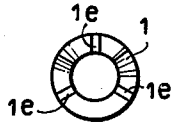
FIG. 8
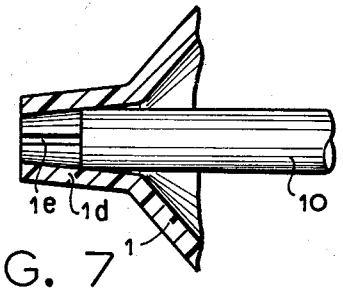
FIG. 7

AUTOMATIC SHARP PENCIL

BACKGROUND OF THE INVENTION

This invention relates to an automatic sharp pencil and more particularly to a knock type sharp pencil provided in its outer cylinder with a core holding mechanism having an ability to move a core forwardly by a given length when a knock portion is pushed.

In such kind of conventional sharp pencil heretofore proposed, an engagement surface for defining the front end of a movable range of a chuck ring is formed by a step portion arranged in the inner surface of the outer cylinder. As a result, in order to deliver the core by a given length, it is necessary to work the outer cylinder with a high precision and accurately define the position where the core holding mechanism is secured to the outer cylinder.

In another conventional sharp pencil heretofore proposed, a chuck ring of a lead chuck is enclosed in a threaded cylinder which is operative to firmly connect a mouth piece to an outer cylinder. In addition, the chuck ring is axially moved in the threaded cylinder and provision is made of an air gap for defining the length of the core gripped by the lead chuck. As a result, such conventional sharp pencil is required to provide a large number of parts, complex in construction and troublesome in assembling. Particularly, such conventional sharp pencil is required to provide a chuck ring of a lead chuck composed of a connected ring and use a bonding step of connecting the mouth piece to the outer cylinder. As a result, the required number of parts becomes large.

SUMMARY OF THE INVENTION

A principal object of the invention, therefore, is to provide a knock type sharp pencil which can eliminate the above mentioned drawbacks which have been encountered with the prior art techniques.

Another object of the invention is to provide a knock type sharp pencil which can make the movable range of a chuck ring constant without precisely working parts and which can make the length of a core to be delivered constant.

A further object of the invention is to provide a knock type sharp pencil which is simple in construction, small in the number of parts, easily workable and less expensive.

A still further object of the invention is to provide a knock type sharp pencil which can reliably and accurately determine a position where a core holding mechanism is located in an outer cylinder.

Another object of the invention is to provide a knock type sharp pencil which can easily mount a mouth piece and lead chuck mechanism in an outer cylinder.

A further object of the invention is to provide a knock type sharp pencil which can easily form an inner cylinder for constructing a core holding mechanism by working a metal pipe.

A feature of the invention is the provision of a knock type sharp pencil comprising:

(a) an outer cylinder formed of synthetic resin and held by a user;

(b) a mouth piece secured to the front end of said outer cylinder;

(c) a core pipe inserted into said mouth piece and operative to guide a core;

(d) an inner cylinder coaxially arranged in said outer cylinder and provided at its front end with an inwardly bent flange portion and at its rear end with a hook portion whose retractive movement is restricted by a stopper groove formed around the inner peripheral surface of said outer cylinder;

(e) a lead chuck inserted into said inner cylinder and including a chuck portion projecting out of the front end of said inner cylinder;

(f) a chuck ring inserted between said flange portion of said inner cylinder and said chuck portion of said lead chuck;

(g) a core case provided at its rear end with a knock portion and connected to the rear end of said lead chuck; and (h) a spring means arranged in said inner cylinder and inserted between said flange portion of said inner cylinder and the front end portion of said core case, said spring means urging said core case backwardly.

Further objects and features of the invention will be fully understood from the following detailed description with reference to the accompanying drawings.

BRIEF DESCRIPTION OF THE DRAWINGS

FIG. 4 is a perspective view of a sleeve shown in FIG. 3;

FIG. 5 is a longitudinal sectional view of a further embodiment of a knock type sharp pencil according to the invention;

FIG. 6 is a longitudinal sectional view of a still further embodiment of a knock type sharp pencil according to the invention;

FIG. 7 is a longitudinal sectional view of a front end portion of an outer cylinder shown in FIG. 6;

FIG. 8 is an end view of a front end portion of an outer cylinder shown in FIG. 6;

DETAILED DESCRIPTION OF THE PREFERRED EMBODIMENTS

Figure 1:
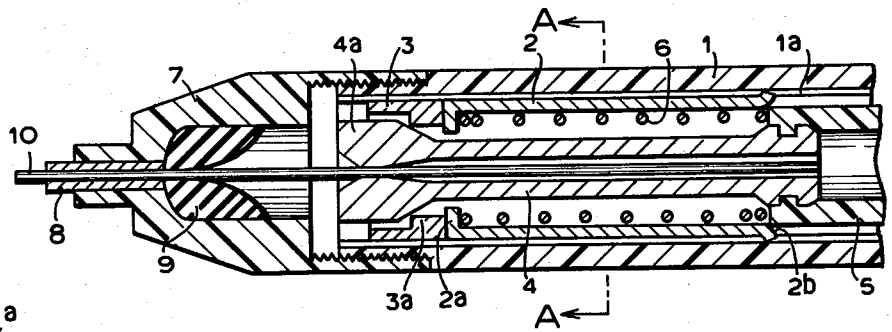
FIG. 1 is a longitudnal sectional view of one embodiment of a knock type sharp pencil according to the invention.
Figure 2:
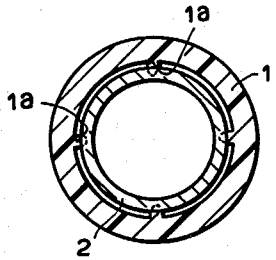
FIG. 2 is a section on line A—A of FIG. 1.

FIGS. 1 and 2 show one embodiment of a knock type sharp pencil according to the invention. In FIGS. 1 and 2, an outer cylinder 1 formed of synthetic resin is provided at its inner periphery with a plurality of ridges 1*a* extending in the axial direction thereof. Into the inner end of the outer cylinder 1 is inserted a sleeve 2 which is provided at its front end with an inwardly bent flange portion 2*a* and at its rear open end with hook portions 2*b* formed by cutting portions of the open end and bending outwardly, the sleeve 2 being urged against a mouth piece 7 to be described later. The outer cylinder 1 is provided at its inner periphery with ridges 1*a* as above described, so that the position of the sleeve 2 is determined when its hook portions 2*b* are brought into engagement with the ridges 1*a* of the outer cylinder 1. As a result, the sleeve 2 can easily be inserted into the outer cylinder 1 and is firmly secured thereto. Between the flange 2*a* of the sleeve 2 and the front end of a core case 5 to be described later is inserted a spring 6 urged in the axial direction against the flange 2*a*. Inside the spring 6 is inserted a lead chuck 4 connected in its rear end to the core case 5 and movable in the axial direction thereof. The lead chuck 4 is provided at its front end with a chuck portion 4*a* forwardly projecting out of the sleeve 2. Outside the chuck portion 4*a* is mounted a chuck ring 3 which is provided with an engagement portion 3*a* adapted to be brought into contact with the flange portion 2*a* of the sleeve 2. The spring 6 functions to urge the core case 5 and the lead chuck 4 connected thereto toward the rear end of the outer cylinder 1.

On the front end of the outer cylinder 1 is mounted the mouth piece 7 which is provided at its front end portion with a core guide pipe 8 secured thereto. The mouth piece 7 is provided therein with a soft rubber 9 arranged near the inner end of the core pipe 8 and operative to stop the backward movement of a core 10. As a result, if the core case 5 is pushed forwardly against the action of the spring 6, the lead chuck 4 is forwardly moved to deliver a given length of core 10 from the front end of the mouth piece 7. When pressure applied to the core case 5 is released, the repulsive force of the spring 6 causes the lead chuck 4 to move backwardly, while the core 10 is prevented from backwardly moving by means of the soft rubber 9. Then, the chuck ring 3 is brought into engagement with the chuck portion 4*a* of the lead chuck 4 such that the chuck ring 3 is operative to hold the core 10 therein under its protruded condition.

Figure 3:
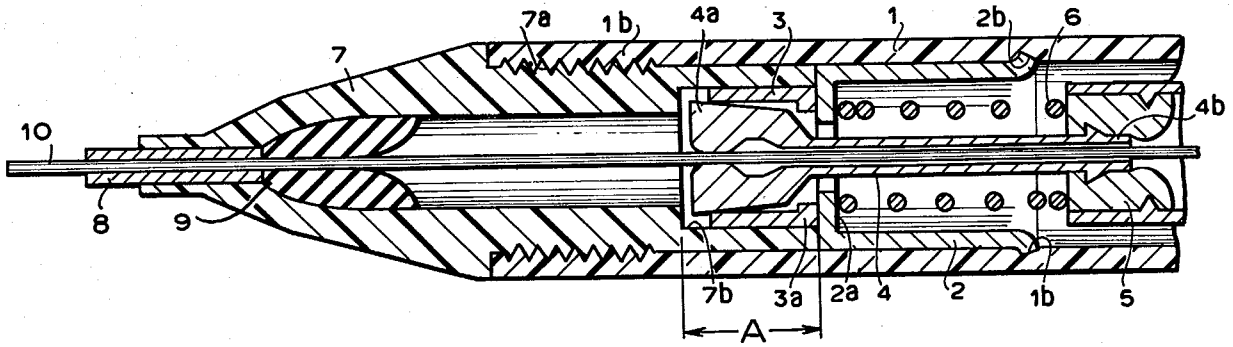
FIG. 3 is a longitudinal sectional view of another embodiment of a knock type sharp pencil according to the invention.

FIGS. 3 and 4 show another embodiment of a sharp pencil according to the invention. In the present embodiment, one end of the mouth piece 7 is provided at its outer periphery with a threaded portion 7*a* and at its inner periphery with a step portion 7*b*. Between the step portion 7*b* of the mouth piece 7 ad the flange portion 2*a* of the sleeve 2 is formed a chamber for forming a core protrusion length adjust distance A. The mouth piece 7 is provided at its front end with a core pipe 8 secured thereto. The mouth piece 7 is provided therein with a soft rubber 9 arranged near the inner end of the core pipe 8 and operative to stop the backward movement of the core 10. The threaded portion 7*a* formed around the outer periphery of one end of the mouth piece 7 is detachably engaged with a threaded portion formed around the inner periphery of the outer cylinder 1 formed of synthetic resin. The outer cylinder 1 is provided around its inner periphery with an engagement groove 1*b*. The sleeve 2 is brought into engagement with the inner periphery of the outer cylinder 1 such that the inner flange 2*a* of the sleeve 2 is urged against the rear end of the mouth piece 7 and that resilient outer hook portions 2*b* formed by cutting and outwardly bending the open end of the sleeve 2 are brought into engagement with the engagement groove 1*b* of the outer cylinder 1. In the chuck ring 3 whose axial movement is limited to the distance A between the step portion 7*b* of the mouth piece 7 and the inner flange 2*a* of the sleeve 2 is inserted a chuck portion 4*a* of a lead chuck 4 and a spring 6 for urging the lead chuck 4 toward its retractive direction is arranged in the sleeve 2 and inserted between the inner flange 2*a* of the sleeve 2 and the front end surface of a core case 5 secured to the rear end 4*b* of the lead chuck 4.

As can be seen from the above, the mouth piece 7 is threadedly engaged with the outer cylinder 1 and the rear end of the mouth piece 7 is abutted against the inner flange 2*a* of the sleeve 2. As a result, the distance A of the core pushing out chamber can easily be determined. In addition, the outer cylinder 1 formed of synthetic resin may be formed by extrusion and worked in an easy manner. Moreover, the sleeve 2 formed of metal and including hook portions 2*b* formed by cutting and outwardly bending can be resiliently engaged with the outer cylinder 1 in a simple manner, thereby making the assembly of the sharp pencil easy.

FIG. 5 shows a further embodiment of a sharp pencil according to the invention. In the present embodiment, the front end portion of an outer cylinder 1 formed of synthetic resin is provided therein with an engagement step portion 1*c*. A mouth piece 7 formed of synthetic resin is engaged with and firmly secured to the step portion 1*c*. Into the front end portion of the mouth piece 7 is inserted a core guide pipe 8. The mouth piece 7 is provided at its rear end portion with an engagement portion 7*b* projecting outwardly from the outer periphery of the mouth piece 7 and adapted to be engaged with the step portion 1*c* of the outer cylinder 1. The mouth piece 7 is inserted into the outer cylinder 1 through its open rear end and projected out of the front end of the outer cylinder 1 as shown in FIG. 5.

The outer cylinder 1 encloses therein an axially movable core case 5. The core case 5 is provided at its front end portion with a lead chuck 4 threadedly engaged therewith and provided at its rear end portion with a knock portion including an eraser 11.

The front end portion of the lead chuck 4 is inserted into and engaged with a chuck ring 3 which is slidably movable in a bore 12 of the mouth piece 7 and is stopped when it reaches to the front end portion 12*a* of the bore 12. The backward movement of the lead chuck 4 is restricted by the front end flange portion of a metal sleeve 2 inserted in the outer cylinder 1. That is, the sleeve 2 is provided at its front end with a flange portion 2*a* and at its rear peripheral end with raised hook piece 2*b* formed by cutting the rear end of the sleeve 2. The backward movement of the sleeve 2 is stopped by resiliently engaging the raised hook pieces 2*b* with engagement grooves 1*b* formed in the inner wall of the outer cylinder 1. Such resilient engagement of the raised hook pieces 2*b* of the sleeve 2 with the engagement grooves 1*b* of the outer cylinder 1 can simply be attained by inserting the sleeve 2 through the rear open end of the outer cylinder 1 into the latter, and as a result, it is possible to stop the backward movement of the mouth piece 7.

The lead chuck 4 inserted into the sleeve 2 is kept under this condition. For this purpose, between the flange portion 2*a* of the sleeve 2 and the front end of the core case 5 is inserted a spring 6.

If the knock portion, for example, is pushed, the lead chuck 4 is moved forwardly in the axial direction shown by an arrow to release the chuck portion 4*a* from the chuck ring 3, thereby delivering a given length of the core 10 from the mouth piece 7. When the knock portion is released, the spring 6 functions to retract the lead chuck 4 which is then again gripped by the chuck ring 3. Under this condition, the sharp pencil can take notes.

FIGS. 6 to 9 show a still further embodiment of a knock type sharp pencil according to the invention. The sharp pencil shown in FIGS. 6 to 9 is composed of an outer cylinder 1 formed of plastics and made integral into one integral body and a core holding mechanism 13 enclosed in the outer cylinder 1. The core holding mechanism 13 is composed of a lead chuck 4 including a core 10 extending therethrough, a core case 5 connected to the rear end of the lead chuck 4, a chuck ring 3 operative to grip a chuck portion 4*a* formed at the front end of the lead chuck 4, a sleeve 2 brought into contact with the rear end of the chuck ring 3 to define one end of the movable range B of the chuck ring 3, and a spring 6 located in the sleeve 2. The spring 6 functions to urge and retract the core case 5 and the lead chuck 4 connected thereto relative to the sleeve 2. As a result, if a knock button 14 is not pushed, the lead chuck 4 is urged and retracted relative to the chuck ring 3 to grip the core 10.

The core 10 is projected forwardly out of the front end of the lead chuck 4 and extending through the guide portion 1*d* formed at the front end of the outer cylinder 1 and is projected outwardly. As shown in FIGS. 7 and 8, the guide portion 1*d* is of a tapered cylindrical body having an inner end whose diameter is slightly larger than the diameter of the core 10 and an outer end whose diameter is slightly smaller than the diameter of the core 10. The outer end of the guide portion 1*d* is divided into a plurality of sectors by means of axially extending slits 1*e* such that the core 10 is axially movable along the guide portion 1*d* with a proper friction.

Figure 9:
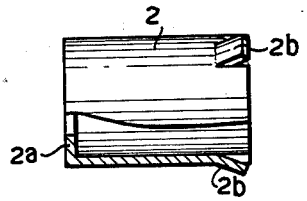
FIG. 9 is a side elevational view of a sleeve of a knock type sharp pencil shown in FIG. 6, partly shown in section.

As shown in FIG. 9, the sleeve 2 is provided at one end with an inwardly extending annular flange 2*a* adapted to be brought into engagement with a step portion formed in the inner periphery of the outer cylinder 1 and with the chuck ring 3 and one end of the spring 6. The sleeve 2 is provided at the other end thereof with a plurality of hook pieces 2*b* formed by cutting one portion of the peripheral wall of the sleeve 2 and adapted to be brought into engagement with step portion formed in the inner surface of the outer cylinder 1.

When the sleeve 2 constructed as above described and assembled with the other core holding mechanism constitutional elements under a given relation is inserted into the outer cylinder 1 through the rear end thereof, each hook piece 2*b* moves along the inner periphery of the outer cylinder 1 with the front end of the hook piece 2*b* in contact therewith. When the front end 2*a* of the sleeve 2 makes contact with the step portion formed in the inner surface of the outer cylinder 1, the sleeve 2 assumes a condition under which the sleeve 2 can not be moved forwardly. Under such condition, when the sharp pencil takes notes, the pressure subjected to the core 10 is transmitted through the lead chuck 4 and chuck ring 3 to the sleeve 2 which is then urged rearwardly relative to the outer cylinder 1. But, the engagement of the front end of each hook piece 2*b* of the sleeve 2 with the engagement groove 1*b* of the outer cylinder 1 prevents the sleeve 2 from retracting.

In the present embodiment, the sleeve 2 is provided at its rear end with the hook pieces 2*b*, but these hook pieces 2*b* may be located at any position along the peripheral wall of the sleeve 2 with similar effect being obtained.

Figure 10:
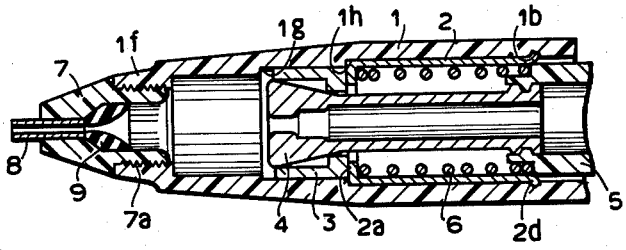
FIG. 10 is a longitudinal sectional view of another embodiment of a knock type sharp pencil according to the invention.
Figure 11B:
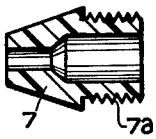
FIG. 11B is a longitudinal sectional view of a mouth piece shown in FIG. 10 prior to its connection with a front end portion of an outer cylinder.
Figure 11A:
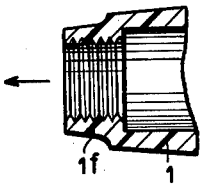
FIG. 11A is a longitudinal sectional view of a front end portion of an outer cylinder shown in FIG. 10 prior to its connection with a mouth piece.

FIGS. 10 and 11 show another embodiment of a knock type sharp pencil according to the invention. In the present embodiment, a mouth piece 7 is provided at its rear end portion with an outer threaded portion 7*a* which is brought into engagement with an inner engagement portion 1*f* formed at the front end of an outer cylinder 1 formed of synthetic resin. The outer cylinder 1 is provided at its inner periphery with a first annular groove 1*g*, second annular groove 1*h* and engagement groove 1*b* arranged in succession. The engagement groove 1*b* is formed by urging a raised rear hook portion 2*d* of the sleeve 2 against the inner periphery of the outer cylinder 1 when the sleeve 2 is pressed into the outer cylinder 1 toward the mouth piece 7. The second annular groove 1*h* and engagement groove 1*b* are brought into engagement with an inner flange 2*a* formed at the front end of the sleeve 2 formed of a thin sheet metal and a resilient raised hook portion 2*d*, respectively. The inner flange 2*a* functions to form one end for defining a movable range of a chuck ring 3. The head portion of the lead chuck 4 is projected out of the inner flange 2*a* of the sleeve 2 and its rear end is secured to a core case 5. Between the front end of the core case 5 and the inner flange 2*a* of the sleeve 2 is inserted a spring 6 operative to retract the lead chuck 4.

The mouth piece 7 is provided at its front end with a core guide pipe 8 and at a position near the inner end of the core guide pipe 8 with a soft rubber 9 operative to stop the retractive movement of the core.

Figure 12:
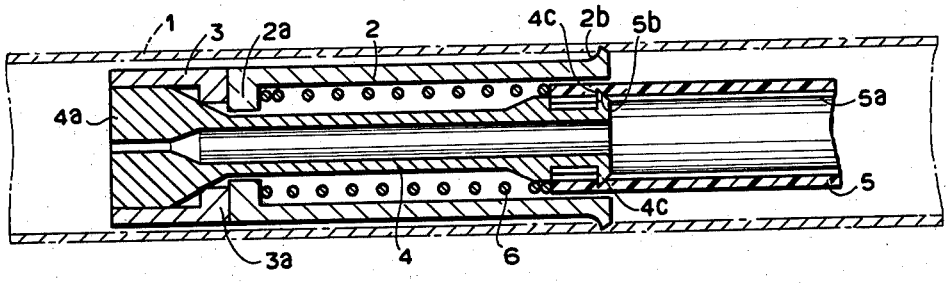
FIG. 12 is a longitudinal sectional view of a core holding mechanism of a further embodiment of a knock type sharp pencil according to the invention.
Figure 13:
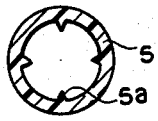
FIG. 13 is a section of a core case of a knock type sharp pencil shown in FIG. 12.

FIGS. 12 and 13 show a further embodiment of a knock type sharp pencil according to the invention. In the present embodiment, a pipe-shaped core case 5 formed of synthetic resin is provided at its inner periphery with a plurality of axially extending ridges 5*a*. The core case 5 is provided at its inner end with an annular groove 5*b* formed when the lead chuck 4 is inserted thereinto under pressure and operative to determine the position of the lead chuck 4. As a result, it is possible to firmly and reliably connect the lead chuck 4 to the core case 5 without inducing slip therebetween. In addition, the front end 4*a* of the lead chuck 4 is brought into engagement with the inner end portion 3*a* of the chuck ring 3, thereby restricting the axial movement of the lead chuck 4 by means of the inner end portion 2*a* of the sleeve 2. Between the inner flange 2*a* of the sleeve 2 and the front end of the core case 5 is inserted a spring 6 operative to retract the lead chuck 4 and cause the inner end portion 3*a* of the chuck ring 3 to grip the front end 4*a* of the lead chuck 4.

The sleeve 2 is formed of metals and is provided at its open end 2*b* with a raised hook portion formed by cutting the open end 2*b*. The raised hook portion formed at the open end 2*b* of the sleeve 2 is urged against the outer cylinder 1 formed of synthetic resin and firmly secured thereto.

The core holding mechanism is constructed such that the chuck ring 3 and sleeve 2 are made stationary in the outer cylinder 1 of the sharp pencil, and that when the core case 5 is forwardly moved, the front end 4*a* of the lead chuck 4 is projected outwardly of the chuck ring 3 to release the core from its locked condition. The core case 5 is provided at its inner periphery with a plurality of ridges 5*a* as shown in FIG. 13, so that the engagement flange 4*c* of the lead chuck 4 can firmly be secured to the core case 5 in a smooth manner.

Figure 14:
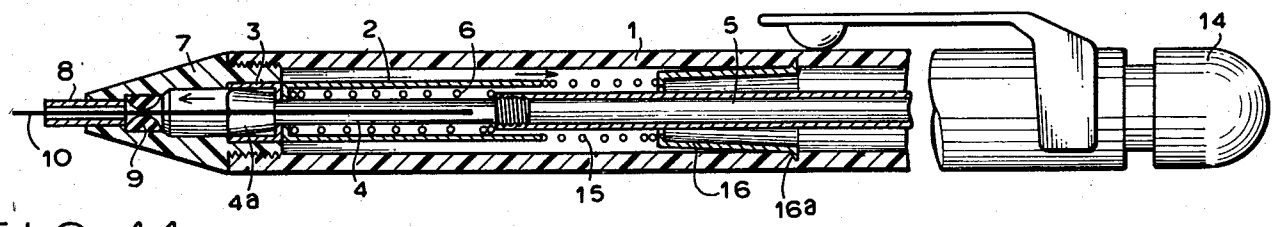
FIG. 14 is a longitudinal sectional view of a still further embodiment of a knock type sharp pencil according to the invention.
Figure 15:
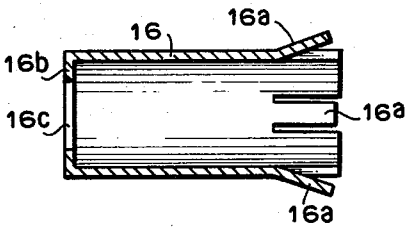
FIG. 15 is a longitudinal sectional view of a sleeve shown in FIG. 14.

FIGS. 14 and 15 show a further embodiment of a sharp pencil according to the invention. In the present embodiment, an outer cylinder 1 is formed of synthetic resin such as vinyl chloride or the like and molded by extrusion. The outer cylinder 1 is provided at its front end portion with a mouth piece 7 threadedly engaged therewith. The mouth piece 7 is provided with a core guide rubber 9 and a core guide pipe 8. The outer cylinder 1 is provided therein with an axially movable core case 5. The core case 5 is provided at its front end with a lead chuck 4 secured thereto and at its rear end with a knock portion 14. The lead chuck 4 is composed of a chuck portion 4*a*. A sleeve 2 brought into engagement with the chuck portion 4*a* and urged forwardly by means of a spring 6 and a chuck ring 3 is pressed by the sleeve 2 and operative to grip the chuck portion 4*a*. As a result, if the knock portion 14 is knocked, the chuck portion 4*a* is delivered in a direction shown by an arrow and projected out of the chuck ring 3 to forwardly move the core 10 by one step.

Between the rear end of the sleeve 2 and a stopper 16 is inserted a cushion spring 15 for absorbing shock produced by the core 10. As shown in FIG. 15, the stopper 16 is formed of metals and formed by press. The stopper 16 is composed of a main cylinder and a plurality of hook pieces 16*a* formed by cutting and raising one portion of the peripheral surface of the rear end portion of the main cylinder. The stopper 16 is provided at its front end surface 16*b* with an opening 16*c* through which is extended the core case 5. The stopper 16 is brought into engagement with the inner wall of the outer cylinder 1 and secured thereto by the resilient force of the plurality of hook pieces 16*a*. In this case, the outer cylinder 1 is formed of synthetic resin so that the inner wall of the outer cylinder 1 is not required to provide an engagement grooves corresponding to the hook pieces 16*a*. The cushion spring 15 inserted between the rear end surface of the sleeve 2 and the front end surface of the stopper 16 functions to absorb the thrust force of the sleeve 2 as shown by an arrow and produced when the core 10 is subjected to excessively large writing pressure. As a result, it is possible to prevent breakage of the core or the like.

Figure 18:
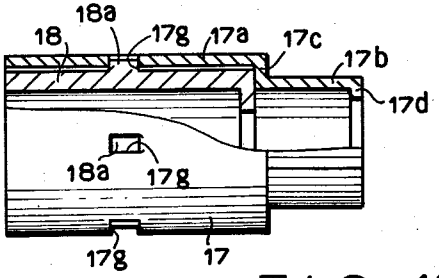
FIG. 18 is a side elevational view of another example of an inner sleeve shown in FIG. 16, partly shown in section.
Figure 17:
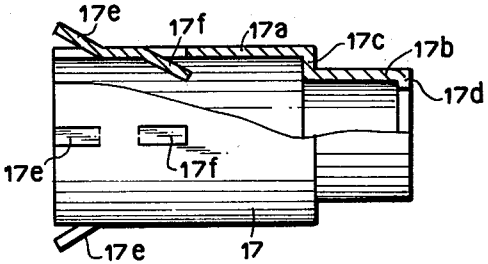
FIG. 17 is a side elevational view of an inner sleeve shown in FIG. 16, partly shown in section.
Figure 16:
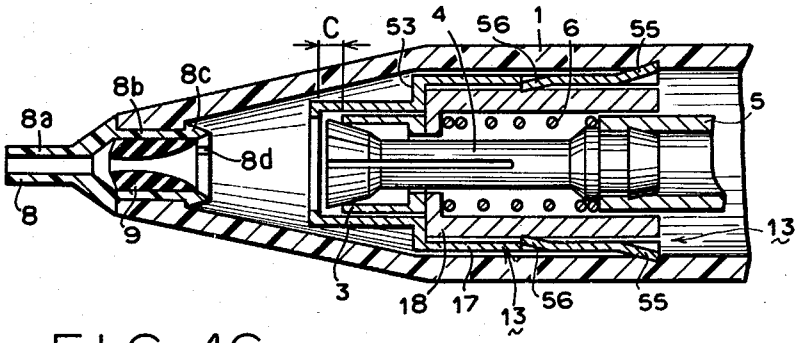
FIG. 16 is a longitudinal sectional view of another embodiment of a knock type sharp pencil according to the invention.

FIGS. 16 to 18 show a still further embodiment of a knock sharp pencil according to the invention. As shown in FIG. 16, an outer cylinder 1 is formed of plastics and made into one integral body. The outer cylinder 1 is provided therein with a core holding mechanism 13 and at its front end with a core guide 8 including a friction rubber 9. The core guide 8 is composed of a front end portion 8*a* having an inner diameter which is substantially equal to the diameter of a core (not shown) and a rear cylindrical portion 8*b* having a diameter which is larger than the diameter of the front end portion 8*a*. The cylindrical portion 8*b* is inserted into an opening formed in the front end of the outer cylinder 1 and secured thereto. For this purpose, the cylindrical portion 8*b* is provided at its rear end with outwardly projecting hook portions 8*c* formed by dividing a plurality of portions by means of axially extending slits 8*d*. As a result, it is possible to resiliently deform the hook portions 8*c* provided at the rear end portion of the cylindrical portion 8*b* in a diameter reducing direction. When the cylindrical portion 8*b* is inserted into the opening of the outer cylinder 1, the rear end portion of the cylindrical portion 8*b* is displaced toward the inside thereof. When the cylindrical portion 8*b* is inserted into a given position, the hook portions 8*c* become engaged with the inner surface of the outer cylinder 1 to firmly secure the core guide 8 to the outer cylinder 1.

Meanwhile, the core holding mechanism 13 is composed of an inner cylinder 17, a sleeve 18 and chuck ring 3 enclosed in the inner cylinder 17, a lead chuck 4 extending through center holes of the sleeve 18 and chuck ring 3, a core case 5 having one end connected to the rear end of the lead chuck 4 and another end connected to a knock button (not shown) and a spring 6 operative to retract the lead chuck 4 and core case 5 relative to the sleeve 18.

As shown in FIG. 17, the inner cylinder 17 is composed of a first portion 17*a* having an inner diameter which is slightly larger than the outer diameter of the sleeve 18 and a second portion 17*b* having an inner diameter which is slightly larger than the outer diameter of the chuck ring 3. These first and second portions 17*a*, 17*b* are connected with each other through a step portion 17*c*. The front end of the second portion 17*b* is bent inwardly to form a flange portion 17*d* adapted to be brought into engagement with the front end of the chuck ring 3. The first portion 17*a* is provided at its peripheral wall with a plurality of first hook portions 17*e* each formed by cutting one portion of the peripheral wall and bending its rear end outwardly and with a plurality of second hook portions 17*f* each formed by cutting one portion of the peripheral wall and bending its front end inwardly. The first hook portions 17*e* are urged against the inner peripheral surface of the outer cylinder 1 such that the forward movement of the inner cylinder 17 in the outer cylinder 1 is permitted, but the backward movement of the cylinder 17 in the outer cylinder 1 is prevented. The second hook portions 17*f* are urged against the outer peripheral surface of the sleeve 18 such that the insertion of the sleeve 18 into the first portion 17*a* is permitted, but the backward movement of the sleeve 18 is prevented.

The knock type sharp pencil constructed as above described according to the invention can be assembled as follows. In the first place, the chuck ring 3 and sleeve 18 are inserted through the rear end of the inner sleeve 17 thereinto. Secondly, the lead chuck 4 is inserted through the front end of the inner sleeve 17 thereinto. Third, the core case 5 is connected to the rear end of the lead chuck 4 to assemble the core holding mechanism 13. Finally, the core holding mechanism 13 is inserted through the rear end of the outer cylinder 1 thereinto. Thus, the sharp pencil can be assembled in a simple manner. The forward movement of the sleeve 18 is prevented when the front end of the sleeve 18 makes contact with the step portion 17*c* of the inner sleeve 17. The backward movement of the sleeve 18 is also prevented when the second hook pieces 17*f* of the inner cylinder 17 are urged against the sleeve 18. The forward movement of the inner cylinder 17 in the outer cylinder 1 is stopped when the front end of the first portion 17*a* makes contact with the inner surface of the tapered portion formed at the front end portion of the outer cylinder 1 and the first hook portions 17*e* are urged against the inner surface of the outer cylinder 1, thereby stopping the backward movement of the inner cylinder 17.

If the knock button is pushed, the lead chuck 4 is forwardly moved to move forwardly the chuck ring 3. When the front end of the chuck ring 3 makes contact with the flange portion 17*d* of the inner cylinder 17, the forward movement of the chuck ring 3 is stopped. From that time the lead chuck 4 only is moved forwardly to release the chuck action from the core. That is, the length of the core to be delivered by one knock operation is determined by the movable distance C of the chuck ring 3.

In the conventional sharp pencil, the stop surface for defining the front end of the movable range of the chuck ring is formed by the step portion formed in the inner surface of the outer cylinder. As a result, if a given length of the core should be delivered, the outer cylinder must be precisely worked and the core holding mechanism must be secured to the outer cylinder at a position which is accurately located.

On the contrary, in the present embodiment of a knock type sharp pencil according to the invention, the inner cylinder 17 is provided with the flange portion 17*d* so that the position where the core holding mechanism 13 is secured to the outer cylinder 1 does not exert any influence upon the length of the core to be delivered. In addition, the outer cylinder 1 is not required to be provided at its inner surface with any step portion. As a result, it is not necessary to form the outer cylinder 1 with the aid of a metal mold. One end portion of a pipe formed by extrusion may be heated and pressed so as to form an outer cylinder 1 having a desired contour. Thus, the knock type sharp pencil may be obtained in a simple and less expensive manner.

FIG. 18 shows another embodiment of a connection between the inner cylinder 17 and the sleeve 18. In the present embodiment, the first portion 17*a* of the inner cylinder 17 is provided around its peripheral wall with a plurality of engagement holes 17*g* and the sleeve 18 is provided at positions corresponding to the engagement holes 17*g* with engagement projections 18*a*. When the sleeve 18 is inserted into a given position in the first portin 17*a* of the inner cylinder 17, each engagement projection 18*a* is projected into the corresponding engagement hole 17*g* to secure the sleeve 18 to the inner cylinder 17. The inner cylinder 17 is provided with the engagement portion 17*d* so that the position where the core holding mechanism 13 is secured to the outer cylinder 1 does not exert any influence to the length of the core to be delivered. In addition, the outer cylinder 1 is not required at its inner surface to be provided with the step portion and hence is not required to be formed with the aid of the metal mold. The outer cylinder may be formed by heating and pressing one end of the pipe formed by extrusion in a simple and less expensive manner.

As stated hereinbefore, the knock type sharp pencil according to the invention has a number of advantages which read as follows.

(a) A knock type sharp pencil according to the invention is simple in construction, small in the number of parts, and less expensive and can be subjected to mechanical working in an easy manner.

(b) In a knock type sharp pencil according to the invention, the movable range of a chuck ring can be made constant without increasing the working accuracy of parts and hence the length of the core to be delivered can be made constant.

(c) In a knock type sharp pencil according to the invention, a core holding mechanism can be located at a precise position in an outer cylinder in a highly reliable manner.

(d) In a knock type sharp pencil according to the invention, a mouth piece and lead chuck mechanism can be easily mounted in an outer cylinder.

(c) In a knock type sharp pencil according to the invention, the inner cylinder of the core holding mechanism can be formed by working a metal pipe in an easy manner.

What is claimed is:

1. A knock type sharp pencil comprising:

(a) an outer cylinder formed of synthetic resin and held by a user;

(b) a mouth piece secured to the front end of said outer cylinder;

(c) a core pipe inserted into said mouth piece and operative to guide a core;

(d) a sleeve coaxially arranged in said outer cylinder;

(e) a lead chuck inserted into said sleeve and including a chuck portion projecting out of the front end of said sleeve;

(f) a chuck ring inersted between said flange portion of said sleeve and said chuck portion of said lead chuck;

(g) a core case provided at its rear end with a knock portion and connected to the rear end of said lead chuck; and (h) a spring means arranged in said sleeve and inserted between said flange portion of said inner cylinder and the front end portion of said core case; said spring means urging said core case backwardly; and (i) said sleeve being provided at its rear end with a hook portion whose retractive movement is restricted by engagement of said hook portion with the inner peripheral surface of said outer cylinder and being provided at its front end with an inwardly bent flange portion, said flange portion defining one end of the range of movement of said chuck ring and being simply and accurately positioned by said engagement of said hook portion with said outer cylinder.

2. The knock type sharp pencil according to claim 1, wherein said mouth piece is provided at its rear end portion with an outer threaded portion and said outer cylinder is threadedly engaged with said mouth piece and provided at its inner periphery with a first groove, a second groove and engagement groove, said first and second grooves defining a slidable distance of said chuck ring, and said sleeve being engaged with said second groove and said engagement groove.

3. The knock type sharp pencil according to claim 1, wherein said sleeve is made in a forward section and a rearward section, said forward section including said flange portion and said rearward section including said hook portion, and a cushioning spring is inserted between the rear end of said forward section and the front end of said rearward section.

4. The knock type sharp pencil according to claim 1, wherein around the rear portion of said lead chuck is arranged a spring for cushioning rearward pressure applied to said lead chuck, said cushioning spring having one end urged against said core case and the other end urged against said flange portion of said sleeve.

5. A knock type sharp pencil comprising:

(a) an outer cylinder formed of synthetic resin and held by a user;

(b) a mouth piece secured to the front end of said outer cylinder;

(c) a core pipe inserted into said mouth piece and operative to guide a core;

(d) a sleeve coaxially arranged in said outer cylinder and provided at its front end with an inwardly bent flange portion, said flange portion defining a limit for one end of the range of movement of said chuck ring;

(e) a lead chuck including a chuck portion and inserted into said sleeve, said chuck portion projecting out of the front end of said sleeve;

(f) a chuck ring inserted between said flange portion of said sleeve and said chuck portion of said lead chuck;

(g) a cushioning spring arranged in the rear of said lead chuck for cushioning the backward moving pressure of said lead chuck; and (h) a cylindrical stopper firmly engaged with the inner wall of said outer cylinder;

(i) one end of said cushioning spring engaging said flange portion and the other end of said spring engaging said stopper.

6. A knock type sharp pencil comprising:

(a) an outer cylinder formed of synthetic resin and held by a user;

(b) a mouth piece secured to the front end of said outer cylinder;

(c) a core pipe inserted into said mouth piece and operative to guide a core;

(d) a two-part sleeve comprising an outer cylindrical member and an inner cylindrical member positioned within said outer cylindrical member, said outer cylindrical member being composed of a reduced diameter portion and large diameter portion with a step portion interposed therebetween, said large diameter portion having a hook portion engaged with the inner peripheral surface of said outer cylinder so as to prevent the backward movement of said sleeve relative to said outer cylinder; said inner cylindrical member having an inwardly bent flange portion at its front end;

(e) a lead chuck inserted into said sleeve and including a chuck portion projecting outt of the front end of said sleeve;

(f) a chuck ring inserted between said flange portion and said chuck portion of said lead chuck, said flange portion defining a limit for one end of the range of movement of said chuck ring;

(g) a core case provided at its rear end with a knock portion and connected to the rear end of said lead chuck; and (h) a spring means arranged in said inner cylindrical member and inserted between said flange portion of said inner cylindrical member and the front end portion of said core case, said spring means urging said core case backwardly.

7. A knock type sharp pencil comprising:

(a) an outer cylinder formed of synthetic resin and held by a user;

(b) a core case slidably received in said outer cylinder;

(c) a lead chuck attached to a front end of said core case and including a chuck portion;

(d) a chuck ring coupled with said lead chuck to grip said chuck;

(e) a two-part sleeve disposed within said outer cylinder and arranged at a position for engaging said chuck ring to limit rearward movement of said chuck ring;

(f) said two-part sleeve comprising an outer cylindrical member and an inner cylindrical member positioned within said outer cylindrical member, said outer cylindrical member having a first portion of larger diameter and receiving said inner cylindrical member and a second portion having a diameter smaller than that of said first portion;

(g) said outer cylindrical member including first hook portions extending outwardly from the peripheral wall of said first portion to engage said outer cylinder and second hook portions extending inwardly from the peripheral wall of said first portion to engage said inner cylindrical member;

(h) said outer cylindrical member further including a flange portion inwardly bent at the front end of said second portion of said outer cylindrical member;

(i) a spring disposed between said core case and said flange portion;

(j) said chuck ring being slidably disposed in said second portion of said outer cylindrical member for movement within a predetermined range;

(k) said inner cylindrical member including an inwardly extending flange at the front end thereof engageable by said chuck ring in one direction of movement of said chuck ring to define a limit for one end of the range of movement of said chuck ring;

(l) said second portion of said outer cylindrical member having an inwardly extending flange portion engageable by said chuck ring in the other direction of movement of said chuck ring to define a limit for the other end of the range of movement of said chuck ring.

8. The knock type sharp pencil according to claim 7, wherein said first hook portions and said second hook portions are formed by obliquely cutting and raising sections of said peripheral wall of said outer cylindrical member.

* * * * *

UNITED STATES PATENT OFFICE

CERTIFICATE OF CORRECTION

Patent No. 4,386,865 Dated June 7, 1983

Inventor(s) Hidehei Kageyama and Takahiko Suzuki

It is certified that error appears in the above-identified patent and that said Letters Patent are hereby corrected as shown below:

Title page, under "Foreign Application Priority Data", the last serial number listed, "55-71079[U]", should be --55-71078[U]--.

Column 3, line 62, "ad" should be --and--.

Column 9, line 48, "portin" should be --portion--.

Column 11, line 50, "outt" should be --out--.

Signed and Sealed this

Thirteenth Day of September 1983

[SEAL]

Attest:

GERALD J. MOSSINGHOFF

Attesting Officer

Commissioner of Patents and Trademarks